United States Patent [19]

Godfrey, Jr.

[11] 4,140,135

[45] Feb. 20, 1979

[54] HYDROPHOBIC COATING FOR TOBACCO SHEET MATERIAL

[75] Inventor: Frederick D. Godfrey, Jr., Maplewood, N.J.

[73] Assignee: Gulf & Western Corporation, New York, N.Y.

[21] Appl. No.: 644,765

[22] Filed: Dec. 29, 1975

[51] Int. Cl.[2] ..... A24B 3/14

[52] U.S. Cl. ..... 131/17 A; 131/15 C; 131/140 C; 106/171; 106/180; 536/68

[58] Field of Search ..... 131/17 A, 17 AC, 140 C, 131/15 C, 15, 268; 106/171, 180; 536/68

[56] References Cited

U.S. PATENT DOCUMENTS

| | | | |
|---|---|---|---|
| 3,185,161 | 5/1965 | Fiore et al. | 131/17 AC |
| 3,343,546 | 9/1967 | Detert et al. | 131/15 C |
| 3,534,743 | 10/1970 | Monte | 131/15 |
| 3,779,783 | 12/1973 | Bunger et al. | 106/171 |
| 4,015,611 | 7/1977 | Holst et al. | 131/268 |

FOREIGN PATENT DOCUMENTS

| | | | |
|---|---|---|---|
| 940129 | 10/1963 | United Kingdom | 131/17 AC |

*Primary Examiner*—Robert W. Michell
*Assistant Examiner*—V. Millin
*Attorney, Agent, or Firm*—William R. Liberman

[57] ABSTRACT

This invention provides coated tobacco product having a hydrophobic coating on at least one surface thereof, the coating comprising a cellulose propionate having an acetyl content of less than about 6% by weight, a hydroxyl content of at least 1.5% by weight, and a content of acyl groups of more than about 3 carbon atoms of less than about 10% by weight. The coating preferably comprises a mixture of the aforesaid cellulose propionate with a glyceride having the general formula:

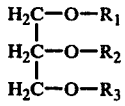

wherein preferably one of the R groups is a group selected from the group consisting of acetyl and propionyl, at least another R residue group represents an acyl containing at least about 12 carbon atoms, any remaining R group is hydrogen. The coating composition is applied, e.g. to a reconstituted tobacco product, as a clear solution in a volatile solvent. The volatile solvents which are suitable include alcohol-water mixtures, esters, and anhydrous alcohol-ester mixtures. If desired, a cross-linking agent may be present to increase the water-resistance of the resulting hydrophobic film.

33 Claims, No Drawings

HYDROPHOBIC COATING FOR TOBACCO SHEET MATERIAL

This application is directed to the formation of a hydrophobic film coating, especially on a reconstituted tobacco product, and the method and composition for forming such a film.

It has long been recognized as desirable, to form a hydrophobic coating for the surface of reconstituted tobacco products. The most common type of such a product is reconstituted tobacco sheet material which is generally formed by applying a thin layer of a liquid suspension of particulate tobacco, and a suitable binder, often combined with a minor proportion of cellulosic pulp fiber, onto a belt, and drying the film to form a self-sustaining sheet material. Such tobacco sheet material has been commonly used, for example, in the manufacture of cigars, both as the wrapper and as the filler material. The art considers such tobacco sheet material satisfactory if it exhibits all the features of a natural tobacco wrapper leaf, for example, such as good color and sheen, natural tobacco feel, good taste, both before and during burning, natural aroma, both before and during burning, a satisfactory burn rate and resistance to water. In addition, the surface of the sheet material should not be sticky to the lips of the smoker and there should be substantially no non-tobacco or bitter flavor characteristic. The relatively long, almost continuous length of reconstituted tobacco sheet material that can be mechanically formed is, of course, more readily suited for use on automated machinery than are the natural, individual tobacco leaves. The sheet materials tend to have more uniform physical characteristics and, of course, can be formed to any desired width and length, thus rendering automated operation far more simplified. However, problems have arisen in the manufacture of the sheet material, and one common problem is that the reconstituted tobacco sheet material is hydrophilic and thus has a tendency to stick to a smoker's lips in much the same manner as cigarette paper but completely unlike natural tobacco. In an attempt to overcome the problem of wetting the reconstituted tobacco sheet and further to improve the surface appearance of the sheet, providing the sheet with good color and sheen and feel of natural tobacco, by providing a hydrophobic coating which is non-wetted and non-sticky to the lips of the smoker, it is necessary to avoid a detrimental change to the taste of the tobacco either before or during burning or smoking.

Various materials have been tried by the art in an attempt to form a coating which avoids the wetting or stickiness problem. For example, the art has attempted to coat the sheet material with a film of a water-insoluble cellulose ether derivative such as ethyl cellulose (U.S. Pat. Nos. 3,185,161 and 3,185,162); however, such materials tend to provide a bitter taste to the tobacco sheet and further result in an aroma, during smoking, which is not typical of natural tobacco. Water-insoluble nitro-cellulose was also utilized as a tobacco-coating material. However, as it is well-known that such material is extremely dangerous, the commercial uses for it are extremely limited regardless of its effectiveness as a coating agent. Other cellulose derivatives which have been suggested include cellulose esters such as cellulose acetate, in combination with methyl cellulose, in U.S. Pat. No. 3,343,546. Cellulose acetate, however, has not been an especially successful tobacco coating agent as was explained in U.S. Pat. No. 3,500,833 which suggested the use of a particular type of ethyl cellulose material.

Other cellulose esters have been used for a variety of purposes. For example, cellulose propionate is a presently known material suggested for use in printing inks. See the bulletins distributed by the Eastman Kodak Corporation relating to their product known as "Alcohol-Soluble Propionate in Printing Ink," Publication No. X-214A, and "Alcohol-Soluble Propionate in Flexographic and Gravure Printing Inks," Customer Service Report No. 217-1B. A specific type of cellulose propionate has previously been disclosed as a secondary additive for use with acetylated monoglycerides as a combined coating agent for food products and pharmaceutical materials (See U.S. Pat. Nos. 2,808,421 and 3,779,783). The latter patent suggests a use of the acetylated glyceride plus a cellulose propionate in amounts of up to about 12% by weight as a coating composition for food products wherein the composition is applied as a hot melt.

In accordance with the present invention, it has now surprisingly been found that a particularly effective hydrophobic film coating, especially effective for reconstituted tobacco product, can be formed from a cellulose propionate containing at least about 1.5% by weight hydroxyl groups. This coating avoids the characteristics of other previously available coatings in that it provides an appearance, taste, aroma and feel substantially equivalent to that of a natural tobacco leaf, while providing a suitable hydrophobic coating which does not stick to the smoker's lips. Such a coating is extremely useful in the preparation of reconstituted tobacco sheet material which is intended for use on modern cigar making machinery. Most broadly this invention provides a product suitable for oral contact with the human being wherein the product has a continuous coating over at least a portion of its surface, the coating being a continuous film of a cellulose propionate comprising at least about 1.0% by weight hydroxyl group content, preferably about 1.5%, and optimally at least about 2%.

In accordance with one aspect of this invention, a reconstituted tobacco product is provided having at least one surface thereof coated with a cellulose propionate having an acetyl content of less than about 6% by weight, a hydroxyl content of at least about 1.0% by weight, and a content of acyl groups of more than 3 carbon atoms of less than about 10% by weight. In a more preferred embodiment of this aspect of the invention, the coating comprises, in addition, at least one glyceride ester having the following general formula:

$$\begin{array}{l} H_2C-O-R_1 \\ | \\ H_2C-O-R_2 \\ | \\ H_2C-O-R_3 \end{array}$$

preferably at least one of the groups $R_1$, $R_2$, and $R_3$ represent a lower acyl group containing from 2 to about 6 carbon atoms, and most preferably from 2 to about 3 carbon atoms, at least another of the groups $R_1$, $R_2$, and $R_3$ represents an acyl group containing at least about 7 carbon atoms, and any remaining of the groups $R_1$, $R_2$, and $R_3$ being hydrogen. Most preferably, at least one of the R groups is an acetyl group, and at least one of the R groups is an acyl group containing from about 12 to about 30, and optimally about 16 to about 24, carbon atoms.

As yet another aspect of the present invention, there is provided a method for forming a continuous film comprising a cellulose propionate on at least a portion of a surface of a product suitable for oral contact with a human being. The process is especially applicable to the coating of reconstituted tobacco product, and most especially at least one surface of a reconstituted tobacco sheet material. In accordance with the process of this invention, the cellulose propionate, as defined above, is applied as a solution in a volatile solvent. The preferred volatile solvent for a particular cellulose propionate is determined by the solubility characteristics of the particular cellulose ester. For example, certain commercially available cellulose propionates are soluble in alcohol admixed with as much as 45% by weight water. Other cellulose esters are soluble only in anhydrous solvents, such as mixtures of an alcohol and an ester.

In the most preferred embodiment of the process of this invention, the solution also contains a dissolved glyceride as defined above. The film-forming composition can be applied preferably to a reconstituted tobacco product at an elevated temperature, for example, immediately following at least a partial drying of the reconstituted tobacco product as it is formed from a tobacco slurry. It is to be understood, in this regard, that the reconstituted tobacco products which are conventionally now available to the art are formed from a slurry, generally an aqueous slurry, of finely divided tobacco and a suitable binder which is then shaped to the desired product. The most commonly manufactured material is a sheet material made in a manner similar to paper by forming a thin film of the slurry, for example, on a solid stainless steel belt or paper machine wire. In most commercially available reconstituted tobacco products there is also present a minor proportion of other cellulose fibers, for example, paper pulp fibers. Such a film of slurry is dried to form the self-sustaining product, e.g. a sheet. The drying is carried out normally at elevated temperatures and the reconstituted tobacco product from the dryer is especially suitable for serving as the base for the formation of the cellulose propionate film in accordance with the present invention. The volatile solvent is thus more readily flashed off upon contact with the hot reconstituted product, thus improving the efficiency and quality of this operation.

The use of an alcohol/water-soluble cellulose propionate ester is especially suitable for coating reconstituted tobacco material containing a relatively high moisture content, or when the coating operation must be carried out under relatively high humidity conditions. For example, the reconstituted tobacco can have a moisture content, at the time of application of the coating solution, as high as 32% by weight on a wet basis. The humidity conditions can be as high, for example, as 80% relative humidity.

The coating solution can be applied, for example, by conventional means including, for example, a roller coater, a blade coater, size press, gravure coater, or flexographic printing equipment. In addition, the coating solution can be applied in a spray or even by dipping the product into a pool of the solution. This latter procedure is especially adaptable for use with products other than sheet material.

As yet a further aspect of the present invention, there is provided a coating solution especially useful for the formation of a continuous hydrophobic film or coating on products suitable for oral contact with a human being, the solution comprising a volatile solvent and dissolved cellulose propionate as defined above. The coating solution preferably also contains a dissolved glyceride ester, also as defined above. The dissolved solids content, i.e. cellulose propionate and any glyceride ester which is present, is preferably at least about 10% by weight of the total solution. Generally these solutions contain from about 10% to about 25% total solids content, although higher solids content would be useful based upon the solubility of the solids which are present. The solutions of this invention, which are most useful for the formation of the hydrophobic film on the product of this invention following the process of this invention, have a viscosity desirably below about 300 cps and preferably below about 200 cps. Most preferably, the viscosity of the solution of this invention will be in the range of from about 14 to about 160 cps, as measured by a Brookfield RVF 20 rpm viscometer, at 20° C., using a #3 spindle.

The coating solution of the present invention has particular advantages over those coating materials previously available to the art. The present solution can be obtained with a higher solids content and a lower viscosity than previously available coating agents. The capability of providing a higher solids content solution, without the disadvantage of an excessive viscosity, permits the coater to obtain a coating having an improved feel; specifically, lower tackiness. Furthermore, the process is more economical because smaller amounts of generally expensive solvents can be used and less energy is required to evaporate off the smaller amount of solvent. This is especially significant when reconstituted tobacco sheet material is coated and such material is to be used, for example, as cigar wrapper in modern cigar making machinery.

The coating formed by the solution of this invention is further improved by the presence of a cross-linking agent in the solution, which forms a cross-linked film having even greater water resistance. Useful cross-linking resins include, for example, urea-formaldehyde, glyoxal, glutaraldehyde, melamine-formaldehyde resins, dialdehyde starches, and the reaction product of epichlorohydrin plus a polyamide backbone, the backbone in turn having been formed by the reaction of diethylenetriamine and adipic acid (as sold under the trade designation Polycup 171 by Hercules, Inc.).

Although the use of the cellulose propionate alone does result in a useful hydrophobic coating or film, the presence of the glyceride further improves the properties of the final coating. Generally the monoglyceride can be added in amounts of up to about 400% by weight of the cellulose propionate present. Preferably, the weight ratio of cellulose propionate to the glyceride is in the range of from about 8:1 to about 1:3, with the optimum results being obtained with weight ratios of from about 4:1 to about 1:1.

The major component of the hydrophobic coating of the present invention is a cellulose ester, a derivative of propionic acid, having a relatively high hydroxyl content. The propionyl content of the ester is preferably at least about 20% by weight, and the hydroxyl content at least about 1.5% by weight. The cellulose esters, suitable for the coating compositions of the present invention, also can contain a minor percentage of the acetyl ester group, generally not more than about 6%, and preferably at least about 1.5% by weight. In the most preferred embodiment, the cellulose ester includes from about 1.5% to about 4.5% by weight of the acetyl groups, and from about 30% to about 59% by weight of the propionyl groups, the optimum range being up to 51% by weight propional groups.

The cellulose ester can also contain, without losing its effectiveness, a minor proportion of some higher molecular weight ester groups, i.e. those having more than 3 carbon atoms. Generally, however, there should be no more than about 10% by weight of such groups and optimally no more than about 5% by weight, as these groups result in little or no improvement in the operation of this invention, and, in fact, can be detrimental. Generally, these higher molecular weight groups have up to about 30 carbon atoms.

The cellulose propionate resins useful in the present invention are conventional materials commercially available to the art.

The glyceride esters, which form the second component in the preferred coating compositions of the present invention, are glycerides containing most preferably either an acetyl group or a propionyl group as at least one of the ester groups in the molecule, although higher ester groups, including the butyryl or even higher acid groups, can be utilized. Although preferably there should be at least one acid group in the ester molecule which has at least 7 carbon atoms, most preferably this higher molecule weight group is one of the so-called edible oil acid groups, i.e., containing from about 8 to about 24 carbon atoms in a group. Such higher groups are obtained, for example, from animal fats and vegetable oils which may be either hydrogenated or unhydrogenated, the degree of hydrogenation of course having a significant effect in determining the physical properties of the glyceride ester. Suitable higher acid groups include lauryl, myristyl, palmityl, stearyl, oleyl, and the like, which are found in such naturally-occuring triglycerides as, for example, lard, beef tallow, soybean oil, peanut oil, coconut oil, palm oil, menhaden oil, and corn oil.

The glyceryl esters having the preferred proportions of lower acyl groups, e.g. acetyl or propionyl, and higher acyl groups, e.g. from about 8 to about 22 carbon atoms, can be obtained by a variety of presently known procedures. One such procedure is disclosed, for example, in U.S. Pat. No. 2,808,421.

Generally, these glyceryl esters are actually mixtures of a variety of different compounds including, for example, compounds whose molecule includes three of the same acyl groups, compounds whose molecules include three of another acyl group, and compounds whose molecules include mixtures, in varying proportions, of the two groups. The number of possible combinations, of course, increases if a third or fourth group is present in the mixture of esters. Such mixtures also generally include a small proportion of the monoglycerides, i.e. incompletely esterified glycerol. All of these items are to be included within the scope of the term glyceride as useful in accordance with the present invention, and the presence of this mixture is to be taken as being fully within the scope of this invention.

The coating of the present invention is preferably applied as a solution in a volatile solvent. Useful such volatile solvents include the lower alkanols and esters, the lower ketones, and the lower ethers. Examples of such compounds include acetone, ethanol, isobutanol, butanol, methyl ethyl ketone, hexanol, t-butanol esters such as n-propyl acetate, isopropyl acetate, and ethyl acetate, ethylene glycol and diethylene glycol and ethers thereof, such as ethylene glycol monomethyl ether, monoethyl ether, and monobutyl ether, the lower monoalkyl ethers of diethylene glycol wherein the ether group has from 1 to about 4 carbon atoms, such as diethylene glycol monomethyl ether and diethylene glycol monobutyl ether and other like materials.

The effective volatile solvent is determined by the solubility characteristics of the cellulose propionate being used. For example, the preferred solvents are the lower alkanols containing up to about 5 carbon atoms, most preferably not more than about 4 carbon atoms, and optimally up to 3 carbon atoms, when the cellulose propionate ester contains at least about 3% by weight, and preferably at least about 4% by weight, hydroxyl groups, and not more than about 42% by weight propionyl groups. It has been found that these solvents are not only not hindered by the presence of water, but in some cases, especially those alkanols containing at least 3 carbon atoms, are actually improved in their effectiveness by the presence of water. There should be no more than about 45% by weight of water, preferably not more than about 35% by weight water, and optimally no more than about 20% by weight water. The best results are obtainable with solvents containing from about 10% to about 20% by weight water.

As another example, the preferred solvent is an anhydrous solvent, and especially a mixture of a lower alkanol, having up to about 3 carbon atoms, e.g. ethanol, and an acetate ester of a lower alkanol, e.g. ethyl acetate or isopropyl acetate, when the cellulose propionate contains less than about 3% by weight hydroxyl groups and more than about 42% by weight, and preferably at least about 45% by weight, propionyl groups. Generally, these mixtures can contain up to about 80% by weight of the lower alkanol which need not be a solvent individually for the particular cellulose propionate tested, together with the acetate ester which is a solvent for such cellulose propionate. The presence of the alkanol, especially ethanol, lowers the unit cost of the solvent and further increases the safety of use.

Examples of such anhydrous mixtures include ethanol plus ethyl acetate, ethanol plus isopropyl acetate, methanol plus ethyl acetate, ethanol plus n-propyl acetate, ethanol plus n-butyl acetate.

The coating of the present invention, however, can be applied, if desired, by means other than in solution. For example, a hot melt of the coating composition can be applied directly to the surface of the product to be coated. It has been found, however, that the solvent coating is preferred because it provides a thinner film which gives an improved appearance and burning quality compared to that obtainable from the hot melt material. The coating thickness is preferably about 0.001 cms. or less. The coating solution of the present invention can be utilized, most generally, for any application where a varnish is desirable. It is especially applicable for the coating of, or the packaging of, food and pharmaceutical products or other products, such as cigars, which are placed in oral animal contact. The coating solution can also be utilized for the formation of independent self-sustaining films by conventional procedures.

The advantages of the process and composition and coating of the present invention will be more readily apparent together with the optimum conditions for carrying out the invention, by reference to the following working examples. These working examples are presented solely as examples of a preferred embodiment for carrying out the present invention and are not to be taken as exclusive of the full scope of the invention.

EXAMPLE 1

A clear solution of an alcohol-soluble propionate was prepared by adding to 20.4 parts by weight of isopropanol (95% by weight isopropanol) 3 parts by weight of cellulose propionate (having a propionyl content of 39.2 weight percent, an acetyl content of 3 weight percent, a hydroxyl content of 5.4 weight percent, a viscosity of 0.14 seconds as determined by ASTM Method D-1343-54T, D-871-54T, sold by the Eastman Coating Chemicals Division of Eastman Chemical Products, Inc. as CAP504-0.2) and 2.267 parts by weight of water. The mixture was agitated until a clear solution was formed. With continuing agitation, 1.0 part by weight of a distilled acetylated liquid glyceride (having a hydroxyl value of from 0 to 15, saponification value of 375-385, a glycerol content of 1.5% by weight, 96% acetylated, and containing the higher acyl groups obtained from prime steam lard, Myvacet 9-40 sold by Eastman Chemical Products, Inc.) was added.

The coating solution was applied to one surface of a reconstituted tobacco sheet product utilizing conventional roll coating means. The reconstituted tobacco sheet material was prepared, for example, in accordance with the working examples of U.S. patent application Ser. No. 481,454, filed June 20, 1974.

Generally, the reconstituted tobacco sheet is prepared from a dispersion comprising particulate tobacco, cellulose fiber paper pulp having a Canadian Standard Freeness value of 10/15, and comprising as a binder a mixture of methyl cellulose and carboxymethyl cellulose in an aqueous solution. The tobacco pulp dispersion in the binder solution is, in a conventional manner, laid down onto a stainless steel belt which is then passed through a dryer to form the self-sustaining, reconstituted tobacco sheet. The sheet is dried at a temperature of about 165° F., and the coating solution of this invention is applied to the sheet immediately as it leaves the dryer and prior to cooling. This aids in the rapid volatilization of the solvent and thus results in the very rapid formation of the desired hydrophobic film over the top surface of the reconstituted tobacco sheet material.

The coating was applied to the surface of the reconstituted tobacco sheet material at coating levels of 35 mg/square foot, 50 mg/square foot, 75mg/square foot, and 100 mg/square foot. Each coated sheet was then evaluated for performance as wrappers for conventional size finished cigars. The cigars were then stored under standard conditions for a period of about 4 weeks and then tested by having them smoked by expert tasters. All of the products exhibited superior qualities of burn, aroma, taste, and mouth feel, as compared to the uncoated material. The coated cigars did not stick to the lips of the smoker and there was substantially no puckering due to change of the humidity during storage nor adhesion to the cellophane wrapper applied prior to storage.

EXAMPLES 2 & 3

The procedures of Example 1 were repeated except that the relative proportions of the cellulose propionate and the glyceride were varied as shown in the following table:

| Example No. | 2 | 3 |
|---|---|---|
| Component | (Parts by weight) | |
| Cellulose Propionate | 1 | 2 |
| Glyceride | 3 | 1 |

Coated cigars were formed following the procedures of Example 1, but utilizing the coating solution composition of Examples 2 and 3 above. The cigars were all satisfactory, although the cigars formed from the coating solution of Example 3 were somewhat superior to those of Example 2.

EXAMPLES 4 THROUGH 8

Procedures of Example 1 were again repeated but utilizing the coating solution components set forth in the table below:

| Example No. | 4 | 5 | 6 | 7 | 8 |
|---|---|---|---|---|---|
| Component | (Parts by weight) | | | | |
| Cellulose Propionate | 1 | 1 | 1 | 1 | 1 |
| Glyceride | 1 | 1 | | | |
| Anhydrous Ethanol | | | . | 5.9 | 1.8 |
| Anhydrous n-Propanol | | 7.2 | 5.9 | | 7.2 |
| Anhydrous Methanol | 9.8 | | | | |
| Water | | 0.8 | 1.5 | 1.5 | |

The coated cigars were prepared in the same manner as in Example 1 above, and each was found to be satisfactory as regards the qualities of burn, aroma, taste and mouth feel, far superior to those qualities in the uncoated reconstituted tobacco sheet.

The viscosities of the coating solutions in Examples 1 through 8 were measured using a Brookfield Viscometer, #2 spindle, at 20 rpm and 72° F. Similarly the solids content of the solution was measured and the results are set forth below in Table I:

Table I

| Example No. | Solids Content (% by wt.) | Viscosity (cps) |
|---|---|---|
| 1 | 15 | 80 |
| 2 | 15 | 14 |
| 3 | 15 | 40 |
| 4 | 17 | 18 |
| 5 | 20 | 42 |
| 6 | 12 | 50 |
| 7 | 12 | 50 |
| 8 | 10 | 50 |

EXAMPLE 9

A coating solution was prepared following the preparation procedure set forth in Example 1 above but using the following components:

| Component | (Parts by weight) |
|---|---|
| Cellulose Propionate | 3.0 |
| Glyceride (as in Example 1) | 1.0 |
| Glyoxal (40% by wt. solution) | 1.0 |
| Anhydrous Isopropanol | 20.04 |
| Water | 2.23 |

A clear coating solution was formed by mixing the above until clear and applied onto the surface of a paper sheet material. The film was dried and compared to formed film having the identical thickness but utilizing the coating composition for Example 1. The two sheets were coated on both sides, both major surfaces, and immersed in water. The paper coated with the film of Example 9 showed improved water resistance compared to that of the control sample of Example 1.

EXAMPLE 10

A clear solution of a cellulose propionate was prepared by first dispersing into 39.8 parts by weight of anhydrous ethanol, 2.55 parts by weight of a cellulose propionate, (having a propionyl content of 46.3 weight percent, an acetyl content of 1.8 weight percent, a hydroxyl content of 2.07 weight percent, a viscosity of 2.2 seconds, as determined by ASTM Method D-1343, Formula A, D-871, sold by the Eastman Coating Chemicals Division of Eastman Chemical Products, Inc. as CAP-482-20), and 0.45 parts by weight of a second cellulose propionate, (having a propionyl content of 45.5 wt. percent, an acetyl content of 3.3 wt. percent, a hydroxyl content of 2.8 wt. percent, a viscosity of 0.3–0.5 seconds, and sold by Eastman Chemical Products, Inc. as CAP-482-0.5), and then adding 16.2 parts by wt. of ethyl acetate. The cellulose propionate was not soluble in the pure ethanol. The mixture was agitated until a clear solution was formed. With continuing agitation, 1.0 part by weight of a distilled acetylated liquid glyceride (having a hydroxyl value of from 0 to 15, saponification value of 375-385, a glycerol content of 1.5% by weight, 96% acetylated, and containing the higher acyl groups obtained from prime steam lard, Myvacet 9-40 sold by Eastman Chemical Products, Inc.) was added. The solution had a solids content of 10 wt. percent and a Brookfield viscosity #3 spindle, of 225 cps at 20° C.

The coating solution was applied to one surface of a reconstituted tobacco sheet product utilizing conventional roll coating means as in Example 1 to obtain coating levels of 36 mg/square foot, and of 50 mg/square foot, and tested in the making of cigars as in Example 1. A satisfactory product was obtained.

EXAMPLES 11 AND 12

The procedures of Example 10 were repeated except that the relative proportions, by weight, of the glyceride to the combined cellulose propionate (CAP-1 plus CAP-2) were varied as shown in the following table:

| Example No. | 11 | 12 |
|---|---|---|
| Components | (parts by wt.) | |
| Combined Cellulose Propionate | 2 | 1 |
| Glyceride | 1 | 1 |
| Viscosity | 145 cp | 80 cp |

Coated cigars were formed following the procedures of Example 10, but utilizing the coating solutions of Examples 11 and 12, above. The cigars were all satisfying although the cigars of Example 12 were somewhat superior.

I claim:

1. A coated reconstituted tobacco product having a hydrophobic film coating at least one surface thereof, the hydrophobic film consisting essentially of a cellulose propionate having an acetyl content of less than about 6% by weight, a hydroxyl content of at least about 1% by weight, and a content of acyl groups having more than 3 carbon atoms of less than about 10 % by weight, the coating providing an appearance, taste, aroma and feel, substantially equivalent to that of a natural tobacco leaf, before and during burning.

2. The coated tobacco product in claim 1 wherein the reconstituted tobacco product is a reconstituted tobacco sheet material.

3. The coated product of claim 1 wherein the propionyl content of the cellulose propionate is in the range of from about 30% to about 59% by weight.

4. A coated reconstituted tobacco product having a hydrophobic film coating at least one surface thereof, the hydrophobic film comprising a cellulose propionate having an acetyl content of less than about 6% by weight, a hydroxyl content of at least about 1% by weight and a content of acyl groups having more than three carbon atoms of less than about 10% by weight, and not more than about 400% by weight of the cellulose propionate of a glyceride having the formula:

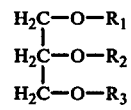

wherein at least one of the groups $R_1$, $R_2$ and $R_3$ is a lower acyl group containing from 2 to 6 carbon atoms, at least another of these groups represents a higher acyl group having more than about 6 carbon atoms, and any remaining R-group being hydrogen, the coating providing an appearance, taste, aroma and feel, substantially equivalent to that of a natural tobacco leaf, before and during burning.

5. The product of claim 4 wherein the lower acyl group is an acetyl group.

6. The coated product of claim 5 wherein the higher acyl group is a saturated group having from about 8 to about 24 carbon atoms.

7. The coated product of claim 6 wherein the coating is cross-linked to increase water-resistance.

8. The coated product of claim 7 wherein the coating has a thickness of not greater than about 0.001 centimeters.

9. The coated product of claim 4 wherein the hydroxyl content of the cellulose propionate is at least about 2% by weight.

10. The coated product of claim 9 wherein the propionyl content of the cellulose propionate is in the range of from about 42% to about 51% by weight.

11. The coated product of claim 4 wherein the hydroxyl content of the cellulose propionate is at least about 3% by weight.

12. The coated product of claim 11 wherein the propionyl content of the cellulose propionate is in the range of from about 30% to about 42% by weight.

13. The coated product of claim 12 wherein the hydroxyl content is at least about 4% by weight.

14. The coated tobacco product of claim 4 wherein the tobacco product is a reconstituted tobacco sheet material and wherein the propionyl content of the cellulose propionate is in the range of from about 30% to about 59% by weight.

15. The coated reconstituted tobacco product of claim 4 wherein the ratio by weight of the cellulose propionate to the glyceride, in the hydrophobic film, is in the range of from about 10:1 to about 1:4, and wherein at least one of $R_1$, $R_2$ and $R_3$ is an acetyl group, at least a second of $R_1$, $R_2$ and $R_3$ is a saturated group containing from about 8 to about 24 carbon atoms.

16. A coating composition, especially adapted for forming a hydrophobic film on reconstituted tobacco product, the composition comprising a cellulose propionate having an acetyl content of less than about 6% by weight, a hydroxyl content of at least about 1% by weight, and a content of acyl groups containing more than 3 carbon atoms of less than about 10% by weight; and a glyceride having the general formula:

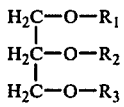

wherein at least one of the groups $R_1$, $R_2$ and $R_3$ is a lower acyl group containing from about 2 to about 6 carbon atoms, at least another of said groups is a higher acyl group comprising more than about 6 carbon atoms and any remaining groups being hydrogen; dissolved in a volatile solvent; the proportion of cellulose propionate-to-glyceride being from about 10:1 to about 1:4.

17. The coating composition of claim 16 wherein the cellulose propionate has a hydroxyl content of at least about 4% by weight.

18. The coating composition of claim 17 wherein the solvent is selected from the group consisting of isopropanol, n-propanol, ethanol and methanol.

19. The coating composition of claim 17 wherein the volatile solvent is an alkanol having up to about 6 carbon atoms.

20. The coating composition of claim 19 wherein the volatile solvent is a co-solvent comprising an alkanol having up to about 4 carbon atoms and water.

21. The coating composition of claim 20 wherein the proportion of water in the co-solvent is not more than about 35% by weight of solvent.

22. The coating composition of claim 16 wherein the total dissolved solids content of the glyceride plus cellulose propionate is in the range of greater than about 10% by weight of the total solution.

23. The coating composition of claim 22 wherein the viscosity of the solution is not greater than about 300 cps at 25° C.

24. The coating composition of claim 17 wherein the total solids content is in the range of about 10% to about 25% by weight of the solution.

25. The coating composition of claim 24 wherein the viscosity is in the range of about 14 to about 160 cps.

26. The coating composition of claim 16 wherein at least one of $R_1$, $R_2$ and $R_3$ is an acetyl group, at least a second of $R_1$, $R_2$ and $R_3$ is a saturated group containing from about 8 to about 24 carbon atoms, and wherein the proportion of cellulose propionate-to-glyceride is in the range of from about 4:1 to about 1:1.

27. The coating composition of claim 16 wherein the hydroxyl content of the cellulose propionate is at least about 2% by weight.

28. The coating composition of claim 27 wherein the hydroxyl content of the cellulose propionate is at least about 3% by weight.

29. The coating composition of claim 28 wherein the propionyl content of the cellulose propionate is in the range of from about 30% to about 42% by weight.

30. The coating composition of claim 27 wherein the propionyl content of the cellulose propionate is in the range of from about 42% to about 51% by weight.

31. A method for applying a hydrophobic film onto at least one surface of a product, the process comprising applying to the surface of the product a coating composition comprising a solution in a co-solvent of an alcohol and water, of a cellulose propionate having an acetyl content of less than about 6% by weight, a hydroxyl content of at least about 3% by weight, and a content of acyl groups having more than 3 carbon atoms of less than about 10% by weight, and permitting the evaporation of the solvent so as to form a hydrophobic film covering the surface of the product.

32. A process for coating a reconstituted tobacco product formed by a process comprising shaping a suspension of particulate tobacco and a suitable binder into a desired shape, and heating the shaped reconstituted tobacco product so as to remove the suspension liquid, to reach a moisture content of a desired value, the coating process comprising applying to the uncooled, dried reconstituted tobacco product a coating composition comprising a solution of a cellulose propionate having an acetyl content of less than about 6% by weight, a hydroxyl content of at least about 3% by weight and a content of acyl groups of more than 3 carbon atoms of less than about 10% by weight, dissolved in a co-solvent system comprising an alkanol and water, and permitting the evaporation of the solvent so as to form the continuous film over the coated surface of the shaped tobacco product.

33. A coated reconstituted tobacco product having a hydrophobic film coating one surface thereof, the hydrophobic film comprising a cellulose propionate having an acetyl content of less than about 6% by weight, a hydroxyl content of at least about 1% by weight, and a content of acyl groups having more than 3 carbon atoms of less than about 10% by weight, and a glyceride having the formula:

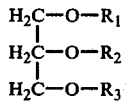

wherein at least one of the groups $R_1$, $R_2$, and $R_3$ is a lower acyl group containing from 2 to 6 carbon atoms, at least another of these groups represents a higher acyl group having more than about 6 carbon atoms, and any remaining R-group being hydrogen, the proportion of the cellulose propionate to glyceride being in the range of from about 4:1 to about 1:1, the coating providing an appearance, taste, aroma and feel, substantially equivalent to that of a natural tobacco leaf, before and during burning.

* * * * *